US005853435A

United States Patent [19]

Avery et al.

[11] Patent Number: 5,853,435

[45] Date of Patent: Dec. 29, 1998

[54] POLYMERIC AMINE-HETEROCYCLIC REACTION PRODUCTS AS FUEL AND LUBRICANT ANTIWEAR, DETERGENCY AND CLEANLINESS ADDITIVES

[75] Inventors: Noyes L. Avery, Bryn Mawr; Joan C. Axelrod, Media, both of Pa.; James T. Carey, Medford, N.J.; Liehpao O. Farng, Lawrenceville, N.J.; Andrew G. Horodysky, Cherry Hill, N.J.

[73] Assignee: Mobil Oil Corporation, Fairfax, Va.

[21] Appl. No.: 367,414

[22] Filed: Dec. 30, 1994

[51] Int. Cl.[6] ..... C10L 1/22; C10L 1/24

[52] U.S. Cl. ..... 44/341; 44/347; 44/432; 44/433; 508/273; 508/276; 508/291

[58] Field of Search ..... 44/432, 433, 341, 44/342, 343, 345, 331, 347, 330; 548/142; 252/51.5 A; 508/273, 276, 291, 347

[56] References Cited

U.S. PATENT DOCUMENTS

| | | | |
|---|---|---|---|
| 2,910,439 | 10/1959 | Fields | 508/273 |
| 3,154,560 | 10/1964 | Osuch | 252/49.6 |
| 3,864,098 | 2/1975 | Honnen | 44/334 |
| 3,966,623 | 6/1976 | Krug et al. | 508/273 |
| 4,282,008 | 8/1981 | Sung | 44/334 |
| 4,301,019 | 11/1981 | Horodysky et al. | 252/49.6 |
| 4,382,869 | 5/1983 | Horodysky et al. | 252/47.5 |
| 4,464,276 | 8/1984 | Sung et al. | 252/50 |
| 4,536,189 | 8/1985 | Sung | 548/138 |
| 4,617,136 | 10/1986 | Doe, Jr. | 508/273 |
| 4,649,025 | 3/1987 | Hwa et al. | 252/100 |
| 4,705,642 | 11/1987 | Sung et al. | 252/51.5 A |
| 4,834,897 | 5/1989 | Sung et al. | 252/51.5 A |
| 4,981,493 | 1/1991 | Sung | 44/331 |
| 5,004,478 | 4/1991 | Vogel et al. | 44/398 |
| 5,112,364 | 5/1992 | Rath et al. | 44/418 |
| 5,137,649 | 8/1992 | Farng et al. | 252/46.3 |
| 5,171,861 | 12/1992 | Ernhoffer et al. | 548/142 |
| 5,186,850 | 2/1993 | Okorodudu et al. | 508/274 |
| 5,205,945 | 4/1993 | Cardis et al. | 508/274 |
| 5,496,382 | 3/1996 | Blain et al. | 44/331 |
| 5,538,520 | 7/1996 | Avery et al. | 44/331 |

*Primary Examiner*—Margaret Medley
*Attorney, Agent, or Firm*—Malcolm D. Keen

[57] ABSTRACT

Polymeric amine sulfur-containing heterocyclic reaction products have been found to be effective antiwear and corrosion inhibiting additives for fuels, including gasolines, and lubricants with excellent high temperature decomposing, cleanliness and detergency/dispersancy features.

6 Claims, No Drawings

POLYMERIC AMINE-HETEROCYCLIC REACTION PRODUCTS AS FUEL AND LUBRICANT ANTIWEAR, DETERGENCY AND CLEANLINESS ADDITIVES

FIELD OF THE INVENTION

This invention is directed to antiwear and corrosion inhibiting additives for fuels and lubricants. More specifically, it concerns polymeric amine sulfur-containing heterocyclic reaction products which are used for said additives.

BACKGROUND OF THE INVENTION

Polyolefins have been used in fuel compositions. Related polyalkylene amines, such as polyisobutyleneamines have been used as gasoline and fuel detergent additives, as reported in U.S. Pat. No. 5,004,478, U.S. Pat. No. 5,112,364, and DE 3,942,860. These polyisobutyleneamines can have an average molecular weight of about 500–2,000, and can be prepared by chlorination or hydroformylation of reactive polyisobutylene and subsequent amination with ammonia, hydrocarbyl amine, hydrocarbyl diamine, hydrocarbyl polyamine, alkoxylated hydrocarbyl amines, or mixtures thereof to provide polyisobutyleneamine-type additives. Ammonia, ethylenediamine, diethylenetriamine, triethylenetetramine, tetraethylenepentamine, piperazines, hexamethylenediamine, hydroxyalkyl ethylenediamines, hydroxyalkyl triethylenetetramines, and the like can be incorporated into the polyalkyleneamines. Mixtures of the above and similar amines can also be used effectively. Alternatively, these amines can be prepared by chlorination or halogenation of appropriate polymeric olefins, and then converted into corresponding polyalkyleneamine derivatives using these or other known methods of manufacture. Although these compositions provide cleanliness, they have not provided the additional performance features required for severe service fuel and lubricant applications.

Low molecular weight (MW) thiadiazoles and thiadiazole derivatives have found extensive use in petroleum product compositions. Mercaptothiadiazole adducts of unsaturated esters and/or alcohols and their borated derivatives have been used as friction reducing additives in lubricants as reported in U.S. Pat. Nos. 4,301,019, and 4,382,869. Thiadiazole-sulfonate reaction products have been reported to be effective multifunctional lubricant additives in U.S. Pat. No. 5,171,861. Alcohol-dimercaptothiadiazole derived hydroxy-borates have been reported to be high temperature stabilizing antioxidant and antiwear additives in U.S. Pat. No. 5,137,649. These compositions, however, do not provide the thermal decomposing and cleanliness features, coupled with the excellent detergency properties required for severe service fuel and lubricant applications. High temperature sustaining properties are critical for severe service fuel and lubricant applications.

Therefore, what is needed is an antiwear and corrosion inhibiting additive for fuels and lubricants that can withstand high temperature applications which are critical for severe service applications.

SUMMARY OF THE INVENTION

This invention concerns a multifunctional antiwear, corrosion inhibiting polymeric amine-heterocyclic additive product of reaction prepared by reacting (a) a $C_{30}$ to $C_{1501}$, approximately 500–2,000 MW hydrocarbyl polyamine which hydrocarbyl group optionally contains at least one heteroatom selected from a member of the group consisting of sulfur, oxygen, or nitrogen or an amine-containing polymeric hydrocarbyl imide with (b) a heterocyclic hydrocarbyl compound. The utilized reaction conditions should be sufficient to form said additive product which imparts additionally, high temperature decomposing, cleanliness, detergency and dispersancy properties to lubricant and fuel compositions containing said product of reaction.

This additive product of reaction provides both excellent corrosion and antiwear properties combined with superior high temperature thermal decomposing and cleanliness properties when used in lubricants, a light distillate hydrocarbon or gasoline. Additional detergency, corrosion inhibiting, metal deactivating and antioxidant properties are also obtained.

Additionally, this invention also concerns a composition or compositions of matter resultant from said reaction products. The composition comprises a lubricant or fuel composition having a major proportion of an oil of lubricating viscosity or a grease prepared therefrom or a liquid hydrocarbon or hydrocarbyl combustible fuel, and a multifunctional antiwear, corrosion inhibiting, effective amount of the hydrocarbyl polymeric amine-heterocyclic additive product of reaction.

It is therefore an object of this invention to provide for small concentrations of a hydrocarbyl polymeric amine-heterocyclic additive product of reaction which possess excellent corrosion, lubricity, and antiwear properties when incorporated into gasoline, diesel, and jet distillate fuels.

It is another object of this invention to provide for products of reaction which also impart cleanliness, high temperature decomposing, detergency and dispersancy properties to lubricant and fuel compositions containing same.

It is another further object of this invention to provide for small concentrations of reaction products mentioned above for incorporation into lubricants such as lube oils and greases to impart similar properties and qualities thereto.

DESCRIPTION OF THE PREFERRED EMBODIMENTS

This invention is directed to a composition and process for making a lubricant or fuel composition comprising a major proportion of an oil of lubricating viscosity or a grease prepared therefrom or a liquid hydrocarbon or hydrocarbyl combustible fuel, and a multifunctional antiwear, corrosion inhibiting effective amount of a hydrocarbyl polymeric amine-heterocyclic additive product of reaction prepared by reacting (a) a $C_{30}$ to $C_{150}$, approximately 500–2,000 molecular weight (MW) hydrocarbyl polyamine which hydrocarbyl group optionally contains at least one heteroatom selected from a member of the group consisting of sulfur, oxygen, or nitrogen or an amine-containing polymeric hydrocarbyl imide with (b) a heterocyclic hydrocarbyl compound under reaction conditions sufficient to form said additive product which additionally, imparts high temperature decomposing, cleanliness, detergency, and dispersancy properties to said composition. Preferably, the reaction takes place at a pressure varying from ambient to about 100 psig, with a temperature varying from ambient up to about 120° C. for a period of about 1 to about 6 hours.

The preferred polyamine is polyisobutyleneamine. In a preferred embodiment of this invention, polyisobutyleneamine having an average molecular weight of approximately 1,000, was reacted with sulfur and nitrogen-containing heterocyclic compounds, as generally described below:

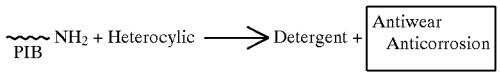

These amine-heterocyclic products can also be made using alternate polymeric amines, such as those exemplified

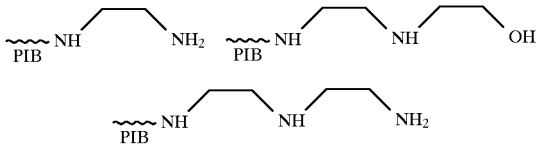

Tri-, tetra-, and pentamines can be used. Propylene diamines, propylene triamines, and related hexamethylene diamines and polyamines and their substituted derivatives can also be effectively used. Amines containing more than 30 carbon atoms are most desirable. Mixtures of amines can be used and can also optionally contain sulfur, oxygen, or additional nitrogen.

Amine-containing polymeric succinimides such as those generally described below can also be used:

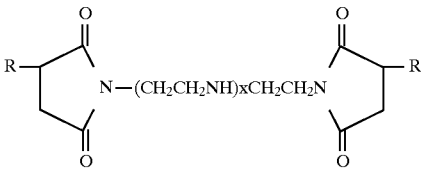

where the hydrocarbyl group R is $C_{30}$–$C_{150}$ hydrocarbyl can be polymeric or oligomeric and x is equal to 0–6, or mixtures thereof, and/or mixtures of linear and branched or cyclic polyethyleneamines.

Sulfur-containing heterocyclic hydrocarbyl amines include but are not limited to, 2-mercapto-1,3, 4-thiadiazole, amino-substituted mercaptothiadiazoles, 2-mercaptothiadiazoles, 2-mercaptothiadiazoles, and the like, as exemplified by:

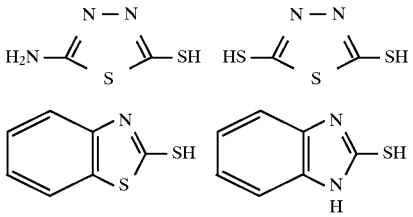

Suitable thiadiazole intermediates include derivatives of 2,5-dimercapto-1,3,4-thiadiazole, other isomeric and substituted thiadiazoles, amino-mercaptothiadiazoles such as 2-mercapto-5-aminothiadiazole, and dialkyl or monoalkyl disulfide derivatives of dimercaptothiadiazoles as exemplified by:

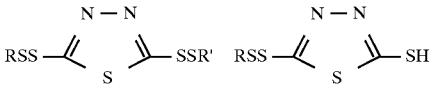

-continued

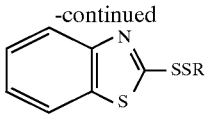

where R and R' are $C_{30}$–$C_{150}$ hydrocarbyl which hydrocarbyl may contain a heteroatom selected from a member of the group consisting of sulfur, oxygen, or nitrogen.

Suitable thiadiazoles include the alkyl thiadiazoles and alkyl disulfides of thiadiazoles, such as those commercially available from Ethyl Corp. as "ETHYL HITEC" thiadiazoles. These substituted thiadiazoles and thiadiazole disulfides are often preferred.

An excess of one reagent or another can be used. Molar quantities, more than molar quantities, or less than molar quantities of either polymeric amine, or heterocyclic species can be used. With the use of a difunctional heterocyclic reactant, a molar ratio of 2:1 of amine: heterocyclic reactant can be used to advantage.

The additives in accordance with the invention have the ability to improve the rust/corrosion inhibiting, thermal stabilizing, dispersant, cleanliness, and antioxidant characteristics of various oleaginous materials such as hydrocarbyl lubricating media, which may comprise liquid oils in the form of either a mineral oil or a synthetic oil, or in the form of a grease in which the aforementioned oils are employed as a vehicle, or liquid hydrocarbyl fuels.

The additives embodied herein are utilized in lubricating oil or grease compositions in an amount which imparts the aforementioned characteristics to the oil or grease as well as reducing the friction of engines operating with the oil in its crankcase. Concentrations of about 0.001 to about 15 wt % based on the total weight of the composition can be used. Preferably, the concentration is from 0.1 to about 3 wt %. It is expected that these materials would also be suitable for use in liquid hydrocarbyl or hydrocarboxy, oxygenated or alcoholic or mixed hydrocarbyl/alcoholic or oxygenated fuel compositions as well as diesel fuels and fuel oils such as heating oils. They are utilized in fuels in amounts of from about 25 to 500 pounds of additive per thousand barrels of fuel and preferably from about 50 to about 250 pounds per 1,000 barrels of fuel.

It is to be understood, however, that the compositions contemplated herein can also contain other materials. For example, corrosion inhibitors, extreme pressure agents and the like can be used as exemplified respectively by metallic phenates sulfonates, polymeric succinimides, non-metallic or metallic phosphorodithioates and the like. These materials do not detract from the value of the compositions of this invention, rather the materials enhance the beneficial characteristics of the disclosed additive products in accordance with the invention.

In general, mineral oils, both paraffinic, naphthenic and mixtures thereof, employed as the lubricant, or grease vehicle, may be of any suitable lubricating viscosity range, as for example, from about 45 SUS at 100° F. to about 6,000 SUS at 100° F. to about 6,000 SUS at 100° F. and preferably, from about 50 to about 250 SUS at 210° F. These oils may have viscosity indexes ranging to about 95 are preferred. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any material which is normally employed for thickening or gelling hydrocarbon fluids for foaming grease can be used in preparing grease in accordance with the present invention.

In instances where synthetic oils, or synthetic oils employed as the lubricant or vehicle for the grease, are desired in preference to mineral oils, or in combination therewith, various compounds of this type may be successfully utilized. Typical synthetic oils include, but are not limited to, polyisobutylene, polybutenes, hydrogenated polydecenes, polypropylene glycol, polyethylene glycol, trimethylolpropane esters, neopentyl and pentaerythritol esters, di(2-ethylhexyl) sebacate, di (2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether, phenoxy phenylethers.

The following examples are merely illustrative and are not meant to be limitations on the scope of this invention.

EXAMPLE 1

Reaction Product of Polyisobutyleneamine and Alkylthiadiazole

Approximately 221 grams of an approximately 50% solution of polyisobutyleneamine having a molecular weight of approximately 1,000 in an inert hyrocarbon solvent was combined with 13.2 grams of an alkyl thiadiazole (made by the oxidative coupling of two moles of nonyl thiol and 2, 5-dimercapto-1,3,4-thiadiazole to form a mixture of nonyl disulfides of the thiadiazole) in a reactor equipped with a heater and agitator. The two ingredients were heated to approximately 80°–90° C. for two hours, afterwhich the product was cooled to room temperature to form a clear light orange liquid.

EXAMPLE 2

Reaction Product of Polyisobutyleneamine and Alkylthiadiazole

Approximately 221 grams of the polyisobutyleneamine solution described in Example 1 was reacted with 26.4 grams of the alkylthiadiazole described above using the generalized reaction scheme of Example 1. The product was a clear light orange liquid at room temperature.

EXAMPLE 3

Reaction Product of Polyisobutyleneamine and Tolytriazole

Approximately 184 grams of the polyisobutyleneamine solution described in Example 1 was combined with 6.7 grams of tolyltriazole in a reactor equipped with an agitator and heater. The reactants were heated to approximately 95° C. for a period of two hours with agitation. The product was cooled to room temperature and isolated as a clear pale yellow liquid.

EXAMPLE 4

Reaction Product of an Amine-containing Polymeric Succinimide and Alkylthiadiazole Approximately 300 grams of an amine-containing polymeric succinimide (made by the reaction of an approximately 900 MW polyisobutylene with maleic anhydride to form an intermediate polymeric succinic anhydride, followed by reaction with tetraethylene pentamine-based polyethyleneamines to form the succinimide) was combined with 26.4 grams of the alkylthiadiazole described in Example 1 in a reactor equipped with heater and agitator. The reactants were heated to approximately 95° C. for two hours. The product, after cooling to room temperature, was a viscous brown liquid.

The products of the Examples were evaluated with respect to cleanliness during thermal decomposition using thermogravimetric analysis as shown in Table 1 below. Thermogravimetric analysis was performed by heating the sample at 20° C./min in air flowing at 100 ml/min using a TA thermogravimetric analyzer. The percent residue remaining at 425° C. was recorded; little or no residue is most desirable.

TABLE 1

High Temperature Performance/Cleanliness Thermogravimetric Analysis

| Example | % Residue @ 425° C. | Temp. for 0% Residue, °C. |
|---|---|---|
| 1 | 0.5 | 477 |
| 2 | 0.8 | 492 |
| 3 | 0.0 | 357 |
| 4 | 8.4 | 639 |
| Amine-Containing polymeric succinimide reactant only of Example 4 | 8.3 | 670 |

As can be seen from the thermogravimetric analyses results, the products show exceptional cleanliness and high temperature decomposition features, especially the products of Examples 1, 2, and 3. Cleanliness features of Example 4, derived from an amine-containing polymeric succinimide are not as favorable as those derived from Examples 1, 2 and 3, which illustrate the more preferable embodiments.

The products of the Examples were evaluated using the 4-Ball Wear Test at 1,800 rpm, 40 kg load, 30 minutes, at 93° C. Reported is the wear factor K which is proportional to the wear volume, and cF, the coefficient of friction.

TABLE 2

4-Ball Wear Test 1,800 rpm, 40 kg load, 30 Minutes 93° C.

| Example | Wear K Factor | Coefficient of Friction cF |
|---|---|---|
| 200 SUS solvent parafinnic neutral lubricating oil | 920 | |
| Reference oil plus 2 wt % Example 1 | 7 | 0.11 |
| Reference oil plus 2 wt % Example 2 | 20 | 0.11 |
| Reference oil plus 2 wt % Example 3 | 1,260 | 0.09 |

The results clearly show the wear reducing properties of this type of composition. Wear volumes obtained by using the polymeric amine-alkyl thiadiazole derivatives have been reduced to almost 1/50th of the initial wear volume of the unadditized oil.

The products of the Examples were evaluated with respect to copper corrosivity properties. Two percent of the products of the Examples were blended into a 200 SUS solvent paraffinic neutral lubricating oil and evaluated using the Copper Strip Corrosivity test, ASTM D-130 at 250° F. for three hours.

TABLE 3

Copper Corrosion Properties
In 200 SUS Solvent Paraffinic Neutral Lubricating Oil

| Example | Corrosion Rating |
|---|---|
| 2 wt % Example 1 in test oil | 1A |
| 2 wt % Example 2 in test oil | 1A |
| 2 wt % Example 3 in test oil | 1A |

The results were all rated as 1A, indicating no corrosive tendencies. In fact, 1A is the best possible rating using this test for copper corrosivity and generally is indicative of superior corrosion inhibiting properties.

Although the preferred use of these additives are in fuel compositions, use in lubricants would also provide many of the same performance advantages shown above. Concentrations of 1 to 500 pounds of additive per thousand barrels of fuel is preferred. In lubricants, the preferred concentrations are from 0.10 wt % to about 2 wt %, or more.

Evaluation of the Products

These compositions can be used in fuels to provide enhanced antiwear and corrosion improving properties, coupled with exceptional cleanliness and thermal stability properties required for next generation fuels. These compositions are readily made in a one-step procedure that can also be implemented during blending of the fuel additive component packages. These additives provide desirable performance features at a modest cost treatment level. In addition, they do not contain any environmentally or toxicologically undesirable materials. Use of these additives in either fuels or lubricants also reduce harmful emissions generated by internal combustion engines.

Although the present invention has been described with preferred embodiments, it is to be understood that modifications and variations may be resorted to, without departing from the spirit and scope of this invention, as those skilled in the art will readily understand. Such variations and modifications are considered within the purview and scope of the appended claims.

What is claimed:

1. A fuel composition comprising a major proportion of a liquid hydrocarbon combustible fuel, and a multifunctional antiwear, corrosion inhibiting effective amount of a polymeric amine-heterocyclic additive product of reaction prepared by reacting (a) a $C_{30}$–$C_{150}$ hydrocarbyl polyamine which hydrocarbyl group optionally contains at least one sulfur, oxygen, or nitrogen atom, of a polymeric amine or an amine-containing polymeric hydrocarbyl imide with (b) a sulfur-containing heterocyclic hydrocarbyl compound selected from the structures below:

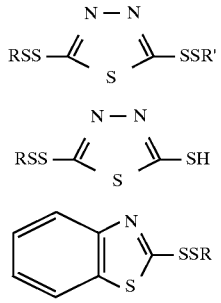

where R and R' are $C_2$–$C_{60}$ hydrocarbyl under reaction conditions sufficient to form said additive product.

2. The composition as recited in claim 1 wherein a) the hydrocarbyl polyamine is a polymeric amine or imide selected from the structures below:

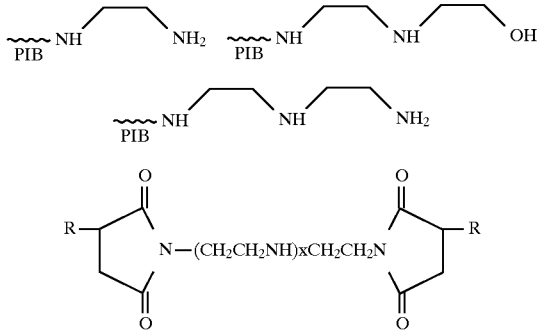

where R is $C_{30}$–$C_{150}$ hydrocarbyl.

3. The composition as recited in claim 1 where a 2:1 molar ratio of amine to heterocyclic reactant is utilized.

4. The composition as recited in claim 1 where (a) is polyisobutyleneamine and (b) is an alkyl thiadiazole formed by oxidatively coupling two moles of nonyl thiol and 2,5-dimercapto-1,3,4-thiadiazole thereby forming a mixture of nonyl disulfides of the thiadiazole whereupon the additive product is obtained at ambient pressure and by heating to a temperature varying from about 80° to 90° C. for about two hours.

5. The composition as recited in claim 1 where the polyamine is polyisobutyleneamine.

6. The composition as recited in claim 1 where (a) is an amine-containing polymeric succinimide and (b) is an alkyl thiadiazole formed by oxidatively coupling two moles of nonyl thiol and 2,5-dimercapto-1,3,4-thiadiazole thereby forming a mixture of nonyl disulfides of the thiadiazole whereupon the additive product is obtained at ambient pressure and by heating to about 95° C. for about two hours.

* * * * *